US006760003B1

(12) United States Patent
Sase

(10) Patent No.: US 6,760,003 B1
(45) Date of Patent: Jul. 6, 2004

(54) MINIATURE ELECTRONIC DEVICE

(75) Inventor: Masahiro Sase, Fussa (JP)

(73) Assignee: Citizens Watch Co., Ltd., Tokyo (JP)

( * ) Notice: Subject to any disclaimer, the term of this patent is extended or adjusted under 35 U.S.C. 154(b) by 0 days.

(21) Appl. No.: 09/297,586

(22) PCT Filed: Sep. 7, 1998

(86) PCT No.: PCT/JP98/04002

§ 371 (c)(1),
(2), (4) Date: May 5, 1999

(87) PCT Pub. No.: WO99/13384

PCT Pub. Date: Mar. 18, 1999

(30) Foreign Application Priority Data

Sep. 8, 1997 (JP) ..... Hei9-242601

(51) Int. Cl.[7] ..... G09G 3/36

(52) U.S. Cl. ..... 345/87; 345/4; 345/5; 345/6; 345/92; 368/68; 368/69; 368/84; 368/242; 359/49

(58) Field of Search ..... 345/87, 173, 92, 345/4, 5, 6; 368/69, 68, 84, 242; 359/49

(56) References Cited

U.S. PATENT DOCUMENTS 4,671,671 A * 6/1987 Suetaka ..... 368/69
5,115,228 A * 5/1992 Harris et al. ..... 345/5
H1096 H * 8/1992 Pederson ..... 359/49
5,487,053 A * 1/1996 Beiswenger et al. ..... 345/173
5,636,185 A * 6/1997 Brewer et al. ..... 368/84
5,847,648 A * 12/1998 Savor et al. ..... 340/309
5,995,456 A * 11/1999 Brewer et al. ..... 368/84

FOREIGN PATENT DOCUMENTS

JP 11-84370 3/1999
JP 11-101976 4/1999

* cited by examiner

*Primary Examiner*—Richard Hjerpe
*Assistant Examiner*—Ali Zamani
(74) *Attorney, Agent, or Firm*—Dickstein Shapiro Morin & Oshinsky LLP

(57) ABSTRACT

A small-sized electronic apparatus is provided which, in the case of use as a watch, can be manufactured at a low cost but with the same thickness, size, weight, etc., as a conventional watch and which includes various sensing means for switching and for shutter opening/closing. Display shutout control means 10 accepts a switching signal from switching means 9 and a closing signal from a timer control circuit 14, and issues a control signal. The control signal is fed to a liquid crystal shutter 13 which uses a liquid crystal panel arranged above an information display part 80, to perform opening/closing of the shutter.

9 Claims, 10 Drawing Sheets

MINIATURE ELECTRONIC DEVICE

TECHNICAL FIELD

The present invention relates to a shutter that is opened or closed for switching between an information display state and a display shutout state of, e.g., a liquid crystal panel constituting an information display unit in a small-sized electronic apparatus, as well as to opening/closing control of the shutter.

BACKGROUND ART

Opening/closing shutter units for use in opening/closing information display parts of small-sized electronic apparatuses, e.g., wristwatches, to alternate between an information display state and a display shutout state have hitherto been known, although most conventional opening/closing shutter units employed mechanical mechanisms.

In the case of the opening/closing shutter units of the above conventional small-sized electronic apparatuses, however, complicated link mechanisms were driven by motors serving as drive sources, whereas the opening/closing operations of the opening/closing shutter were carried out by complicated switch mechanisms acting as the operative members for the opening/closing control. Furthermore, in a case where the opening/closing shutter unit was applied to the wristwatch for wearing around the wrist, it was fairly inconvenient and due to its larger thickness and weight arising from the fact that the opening/closing shutter unit is disposed above the body portion of the wristwatch. Also, the mechanical mechanisms must typically be built from a multiplicity of precisely machined or metal plated components by skilled operators, resulting in increased costs and frequent failures because of the complicated nature of the mechanisms. This prevented the wristwatches whose information display parts used the opening/closing shutter units from becoming widely used.

The present invention was conceived in view of the above problems. It is therefore the object thereof to provide a small-sized electronic apparatus which is free from use of, e.g., a complicated mechanical structure and a complicated switch mechanism acting as an operative member for opening/closing control thereof, and which even when worn around the wrist for use, is easy to wear since it has a thickness and weight no different from the conventional watch, and which can be easily manufactured at lower costs with reduced possibility of failure.

DISCLOSURE OF THE INVENTION

In order to achieve the above object, a small-sized electronic apparatus in accordance with the present invention having information generating means, display drive means for issuing a signal for display and drive on the basis of a signal from the information generating means, and a display unit for providing an information display on the basis of an output signal from the display drive means, comprises switch means for detecting a switch input, and display shutout control means for providing switching control of the display unit between an information display state and a display shutout state on the basis of an output signal from the switch means. This makes it possible to provide switching control of the information display part between the information display state and the display shutout state.

In the small-sized electronic apparatus in accordance with the present invention, display information of the display unit may be subjected to a display shutout by liquid crystal shutter means which uses liquid crystal and is provided in the display unit. In the case of using the liquid crystal shutter means in particular, it would be possible to easily and at lower costs manufacture a watch which is easy to wear even when worn around the wrist since it has thickness and weight no different from a conventional watch, without using a complicated and mechanical structure. Failures can also be reduced.

In the small-sized electronic apparatus in accordance with the present invention, the switch means can be sensor switch means for detecting a sensor switch input. In the case of using the sensor switch as the switch means, switching would be feasible by various sensing functions.

In the small-sized electronic apparatus in accordance with the present invention, arrangement can be such that the display shutout control means provides the display unit with a switching control from the display shutout state to the information display state or with a switching control from the information display state to the display shutout state, on the basis of an output signal from the switch means.

The small-sized electronic apparatus in accordance with the present invention may further comprise timer control means for performing a timer counting action on the basis of an output signal from the switch means such that the display shutout control means can provide t he display unit with a switching control from the information display state to the display shutout state or a switching control from the display shutout state to the information display state on the basis of a time-out signal from the timer control means. This allows free setting of time control during which the display unit is put in the information display state or in the display shutout state, to achieve opening/closing or closing/opening actions.

In the small-sized electronic apparatus in accordance with the present invention, a reflection type deflecting plate can preferably be used as the liquid crystal shutter means. The display part of the display unit can provide a shutter unit presenting a metallic luster in response to the incidence from the external light source in the display shutout state.

In the small-sized electronic apparatus in accordance with the present invention, having information generating means, display drive means for issuing a signal for display and drive on the basis of a signal from the information generating means, and a display unit for providing information display on the basis of an output signal from the display drive means, the display unit may be provided with a switch member, a shutter unit in the form of a shutter having a switch operation opening indicative of an opening of the switch member, and shutter control means for providing opening/closing control of the shutter unit, whereby a shutter of the switch operation opening of the shutter unit is opened under control of the shutter control means.

In the small-sized electronic apparatus in accordance with the present invention, it is preferred that the shutter of the shutter unit be a liquid crystal shutter using liquid crystal.

Also, the small-sized electronic apparatus in accordance with the present invention may employ a reflection type deflecting plate as the liquid crystal shutter.

In this manner, it has become possible to easily manufacture the switch member and the shutter unit in the form of a shutter having a switch operative opening indicative of an opening of the switch member, as well as to make an arbitrary tone of backup light by imparting an arbitrary color to the reflection plate in the display state. In addition, provision at a low cost has become feasible.

BEST MODE FOR CARRYING OUT THE INVENTION

Embodiments of the present invention will now be described with reference to the drawings.

Figure 1:
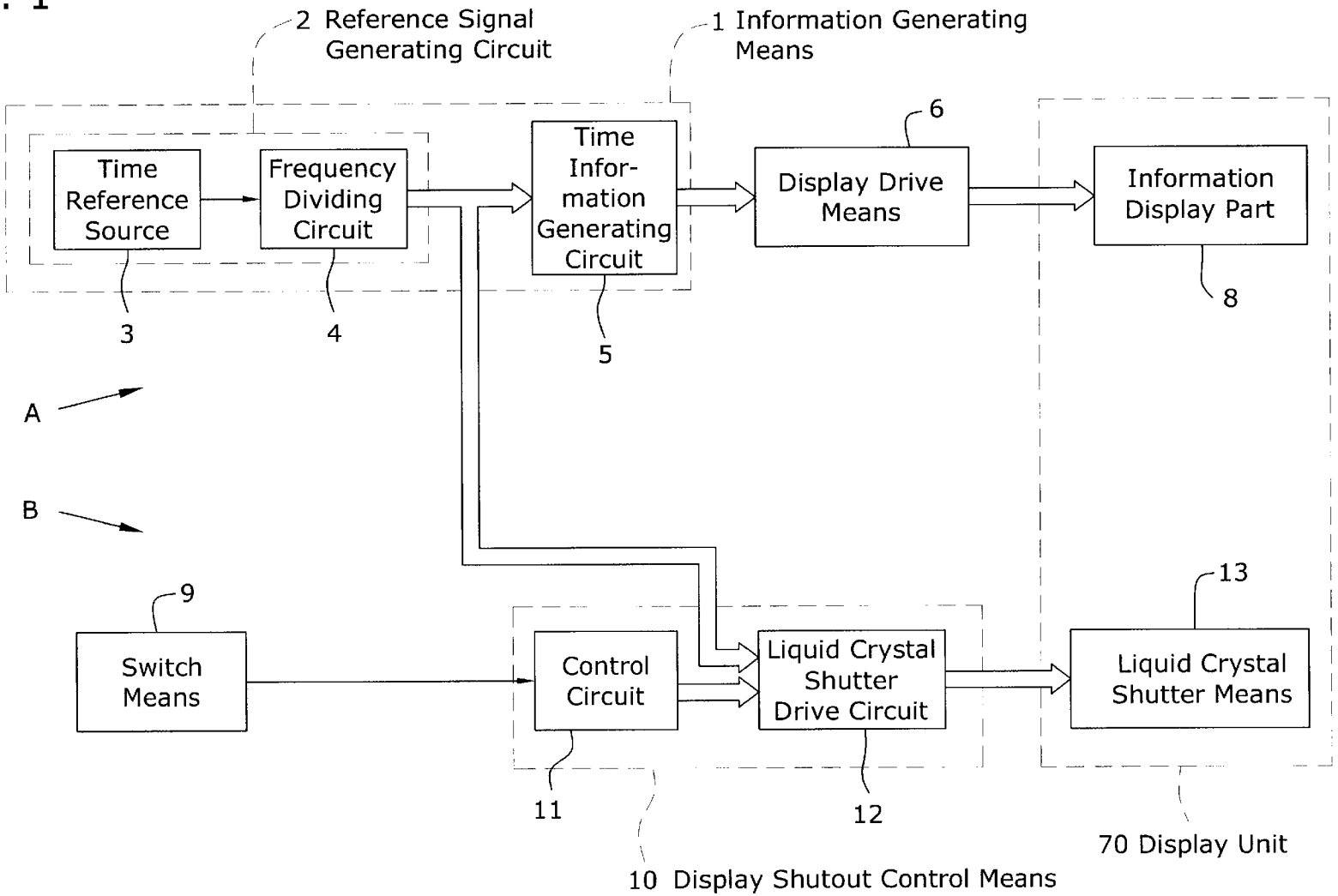
FIG. 1 is a system block diagram of embodiment 1 of a small-sized electronic apparatus in accordance with the present invention.
Figure 2:
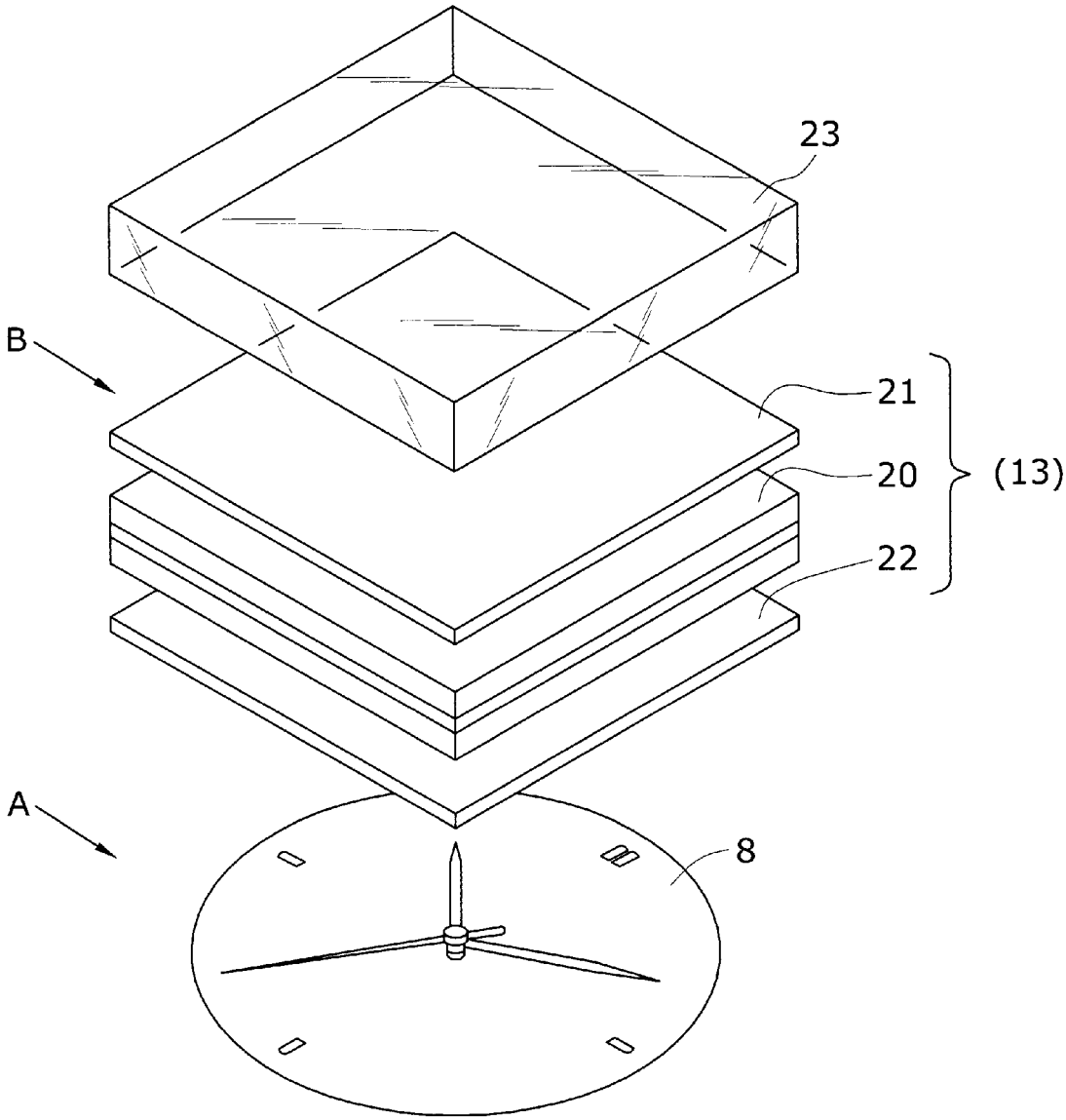
FIG. 2 is an exploded perspective view showing a schematic configuration of a display part of the embodiment 1 of the same small-sized electronic apparatus.

Embodiment 1 of a small-sized electronic apparatus in accordance with the present invention is shown in FIGS. 1 and 2.

FIG. 1 is a system block diagram of the small-sized electronic apparatus in accordance with the present invention, and FIG. 2 is an exploded perspective view showing a schematic configuration of a display part of the same small-sized electronic apparatus.

The embodiment 1 of the small-sized electronic apparatus in accordance with the present invention is described by way of example of an analog quartz watch A. In FIG. 1, information generating means 1 comprises a reference signal generating circuit 2 and a time information generating circuit 5, with the reference signal generating circuit 2 including a time reference source 3 and a frequency dividing circuit 4. The time reference source 3 generates a time reference signal (32,768 Hz). The frequency dividing circuit 4 consists of a plurality of frequency dividers accepting the time reference signal from the time reference source 3 and provides as its output a signal group of predetermined reference signals.

Subsequently, the time information generating circuit 5 issues a 1-sec. step signal in the form of a time signal, on the basis of a predetermined reference signal from the reference signal generating circuit 2. Display drive means 6 serving as a motor drive circuit receives the 1-sec. step signal as its input and issues a 1-sec drive signal. An information display part 8 of a display unit 7 is composed of a pulse motor, a wheel train interlinked with the pulse motor, and hands (hour, minute, second hands) attached to the wheel train. The information display part 8 provides a hand driving display based on the 1-sec. drive signal.

Figure 10:
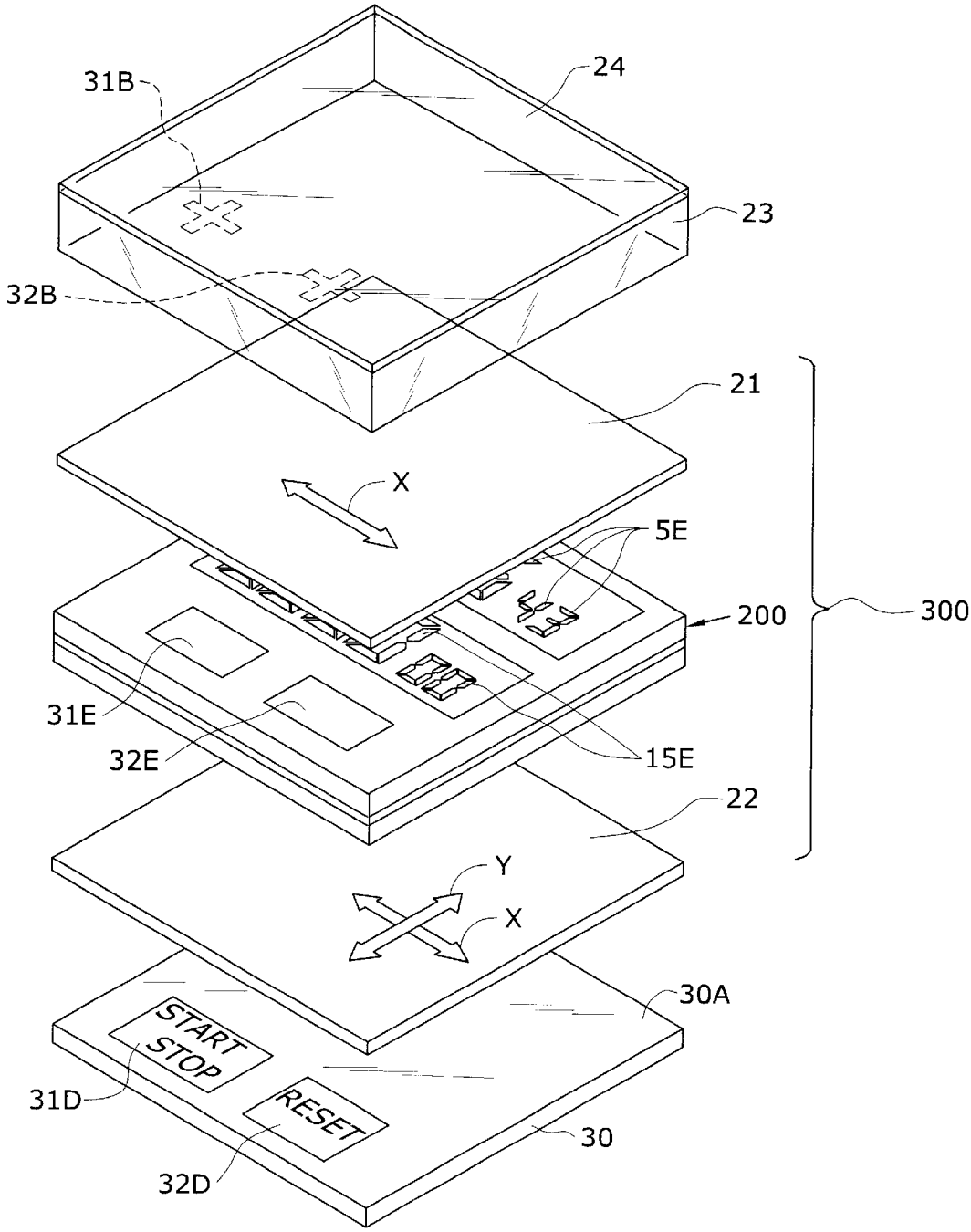
FIG. 10 is an exploded perspective view showing a schematic configuration of the embodiment 4 of the display part of the same small-sized electronic apparatus.

Integrally with or separately from the thus constructed information display part 8 of the display unit 7 of the watch A, liquid crystal shutter means 13 are provided in the form of a liquid crystal panel of a shutter part B and include an absorption type deflecting plate 21 and a reflection type deflecting plate 22 which are layered with a liquid crystal cell 20 sandwiched therebetween as shown in FIG. 2 (illustrated in a separate manner). Furthermore, a windshield glass 23 is arranged thereover. As shown in FIG. 10 of embodiment 4, the absorption type deflecting plate 21 is provided as an absorption type deflecting plate whose one deflection axis is a transmission axis X with an absorption axis on the other, while the reflection type deflecting plate 22 is provided as a reflection type deflecting plate whose one deflection axis is a transmission axis X with a reflection axis Y on the other. In practice, the reflection type deflecting plate for use in this embodiment can be optical film DBEF (brand name) supplied by Sumitomo 3M Ltd. Experimentally, use was made of a combination of a metal grid type deflecting plate (glass plate having a 0.2 $\mu$m pitch metal grid formed thereon), liquid crystal and a phase difference plate.

Description will now be given of characteristics of the above-described deflecting plate without the liquid crystal cell 20 sandwiched. Either one of the absorption type deflecting plate 21 and the reflection type deflecting plate 22 is fixed, with the other deflecting plate being rotated. At an angle (0°) where the transmission axis X of the absorption type deflecting plate 21 is parallel to the transmission axis X of the reflection type deflecting plate 22, a transmission characteristic will appear, whereas when the reflection axis Y of the reflection type deflecting plate 22 is orthogonal to the transmission axis X of the absorption type deflection plate 21, a larger reflection intensity will be presented. For this reason, a lustered reflection characteristic is obtained from an external light source, allowing provision of a shutter presenting a tone of metallic luster (metallic tone) for the incidence of light through the windshield glass 23 of the watch. It is natural that for acquisition of the same functions and effects as the above the absorption type deflecting plate 21 may be substituted by a reflection type deflecting plate, with the reflection type deflecting plate 22 substituted by the absorption type deflecting plate.

In order to allow the liquid crystal shutter means 13 of the shutter part B to be driven as a shutter, as shown in FIG. 1, a switching signal issued from switching means such as a mounting detection sensor switch, an angle (inclination) sensor switch, a touch sensor, a shock sensor and a water pressure detection sensor for detecting water pressure in addition to an ordinary button switch is fed as a control signal to display shutout control means 10 which include a control circuit 11 for controlling the opening/closing action of the shutter and a liquid crystal shutter drive circuit 12 for driving the shutter, thereby providing control of application of voltage to the liquid crystal cell 20 serving as the liquid crystal shutter means 13 of the display unit 7, to perform opening/closing of the shutter. The switching means 9 may provide the opening control of the liquid crystal shutter means 13 or may provide the shutting control thereof. A predetermined reference signal from the reference signal generating circuit 2 is fed to the liquid crystal shutter drive circuit 12 to form a shutter drive signal for driving the liquid crystal shutter means 13.

Figure 3:
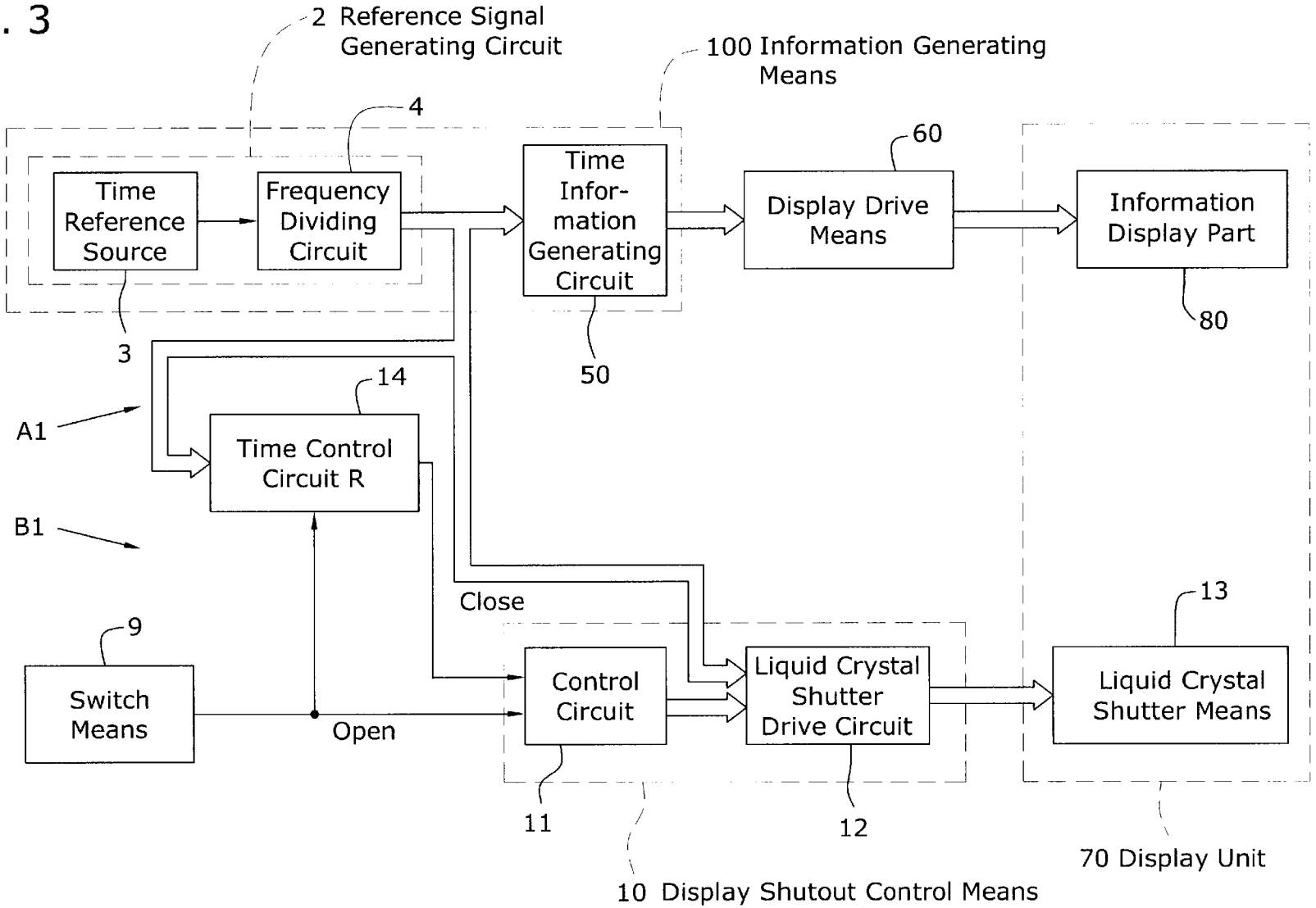
FIG. 3 is a system block diagram of embodiment 2 of a small-sized electronic apparatus in accordance with the present invention.
Figure 4:
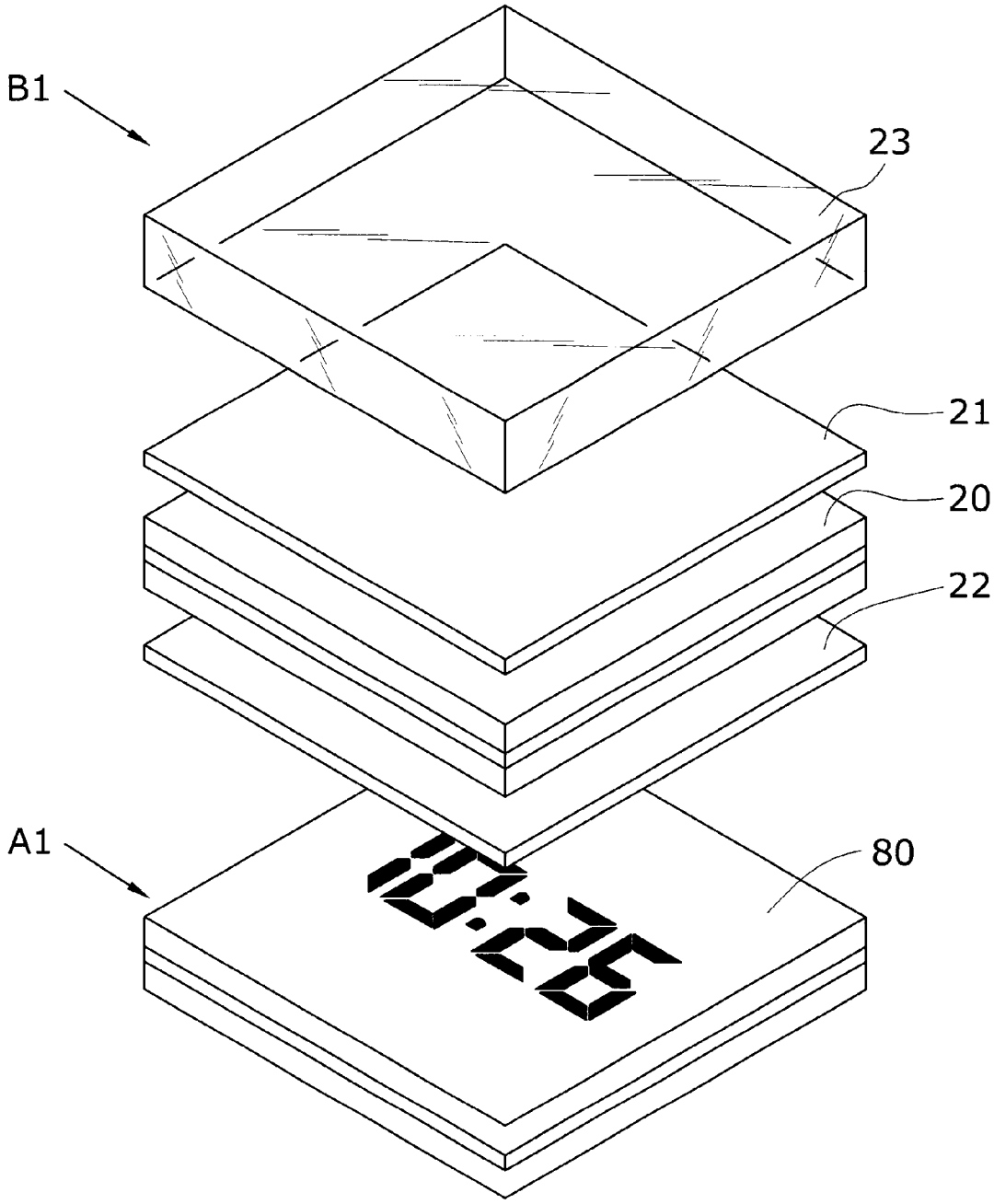
FIG. 4 is an exploded perspective view showing a schematic configuration of the display part of the embodiment 2 of the same small-sized electronic apparatus.

Embodiment 2 of a small-sized electronic apparatus in accordance with the present invention is shown in FIGS. 3 and 4.

FIG. 3 is a system block diagram of the embodiment 2 of the small-sized electronic apparatus in accordance with the present invention, and FIG. 4 is an exploded perspective view showing a schematic configuration of a display part of the same small-sized electronic apparatus.

The embodiment 2 of the small-sized electronic apparatus is described by way of example of a digital quartz watch A1. In FIG. 3, excepting a time information generating circuit 50 in time information generating means 100, display drive means 60, an information display part 80 and a timer control circuit 14, configuration is basically identical to that of the embodiment 1, and therefore like parts are designated by the same reference numerals and are not described again.

On the basis of a predetermined reference signal from the reference signal generating circuit 2, the time information generating circuit 50 acting as a time counter counts the time and issues a time signal. Then, based on the time signal, the display drive means 60 acting as a liquid crystal driver issues a display drive signal. In turn, based on the display drive signal, the liquid crystal panel in the form of the information display part 80 provides a digital time display.

The liquid crystal shutter means 13 constituting the liquid crystal panel of a shutter part B1 configured in the same manner as the embodiment 1 are arranged over the information display part 80 which is a display unit 70 of the watch A1 as shown in FIG. 4.

In order to allow the liquid crystal shutter means 13 of the shutter part B1 to be driven as a shutter, in the same manner as the embodiment 1, a switching signal issued from the switching means 9 is fed as a control signal to the display shutout control means 10 which includes the control circuit 11 for controlling the opening/closing action of the shutter and the liquid crystal shutter drive circuit 12 for driving the shutter, thereby providing control of application of voltage to the liquid crystal cell 20 serving as the liquid crystal shutter means 13 of the display unit 70, to perform opening/closing of the shutter.

On the basis of the switching signal from the switching means 9, as shown in FIG. 3, the liquid crystal shutter means 13 is switched from the display shutout state to the information display state, whereas control of the further provided timer control circuit 14 performing the timer counting action (timer counting is started based on the switching signal from the switching means 9), that is, a closing signal issued from the timer control circuit 14 due to time-out, is provided as a closing signal input to the display shutout control means 10, and this signal acts as a control signal for the display shutout to provide control of application of voltage to the liquid crystal cell 20 serving as the liquid crystal means 13 of the display unit 70 to thereby shutout the display of the liquid crystal panel. Thus, by entering or setting a desired control time (e.g., 5 sec.) into the timer control circuit 14, it is possible to arbitrarily control the time (e.g., 5 sec.) during which the shutter of the liquid crystal shutter 13 remains open.

Alternatively, depending on the purpose of use, the signal issued from the timer control circuit 14 may be an opening signal, but instead the output from the switching means 9 may be provided as a closing signal in order to ensure that the liquid crystal shutter means 13 is switched from the information display state to the display shutout state on the basis of the switching signal from the switching means 9 and that the information display state is restored on the basis of control of the signal issued due to time-out from the further provided timer control circuit 14 performing timer counting action. In either case, the timer counting action starts by use of a reset (R) function or the like.

Figure 5:
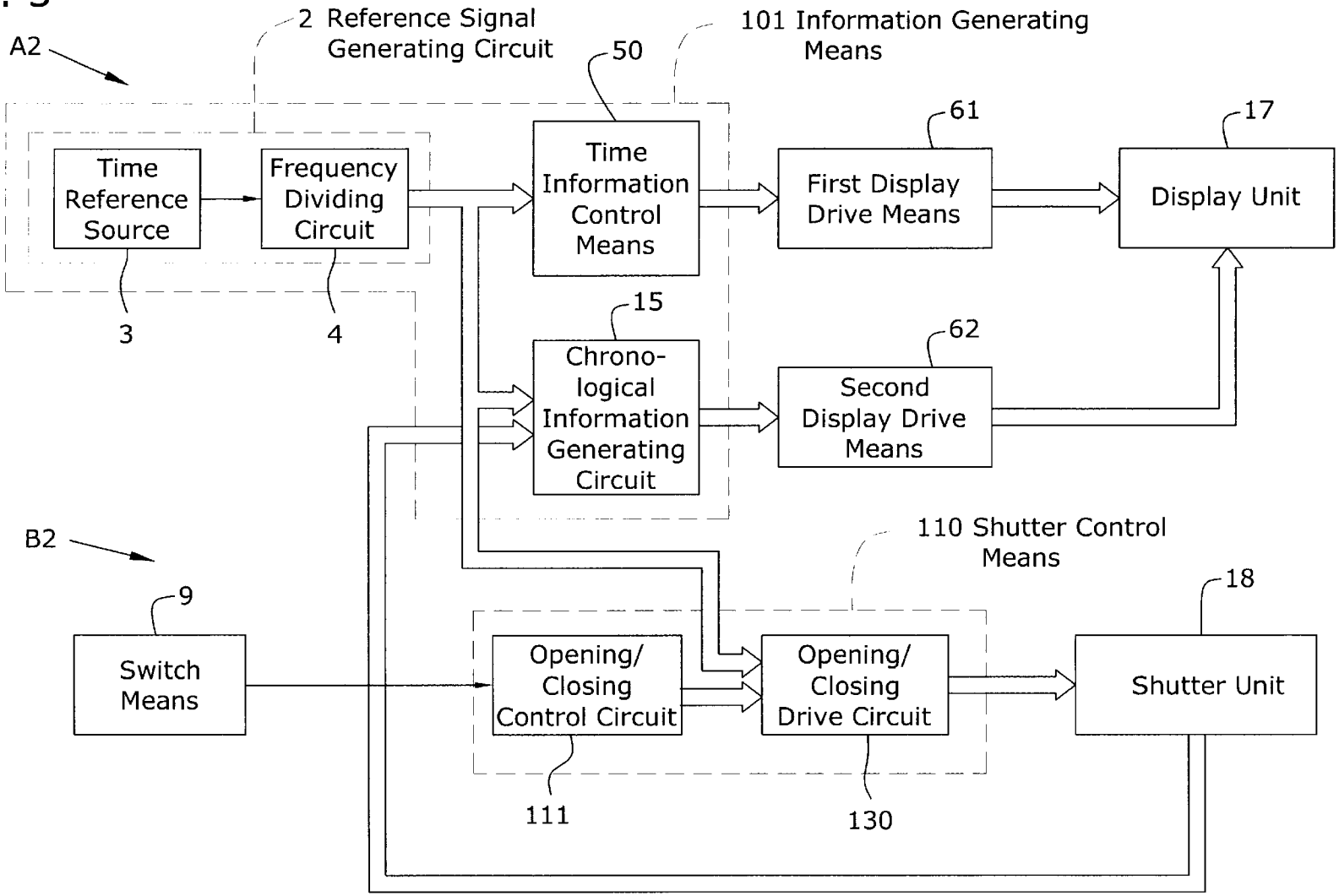
FIG. 5 is a system block diagram of embodiment 3 of a small-sized electronic apparatus in accordance with the present invention.
Figure 6B:
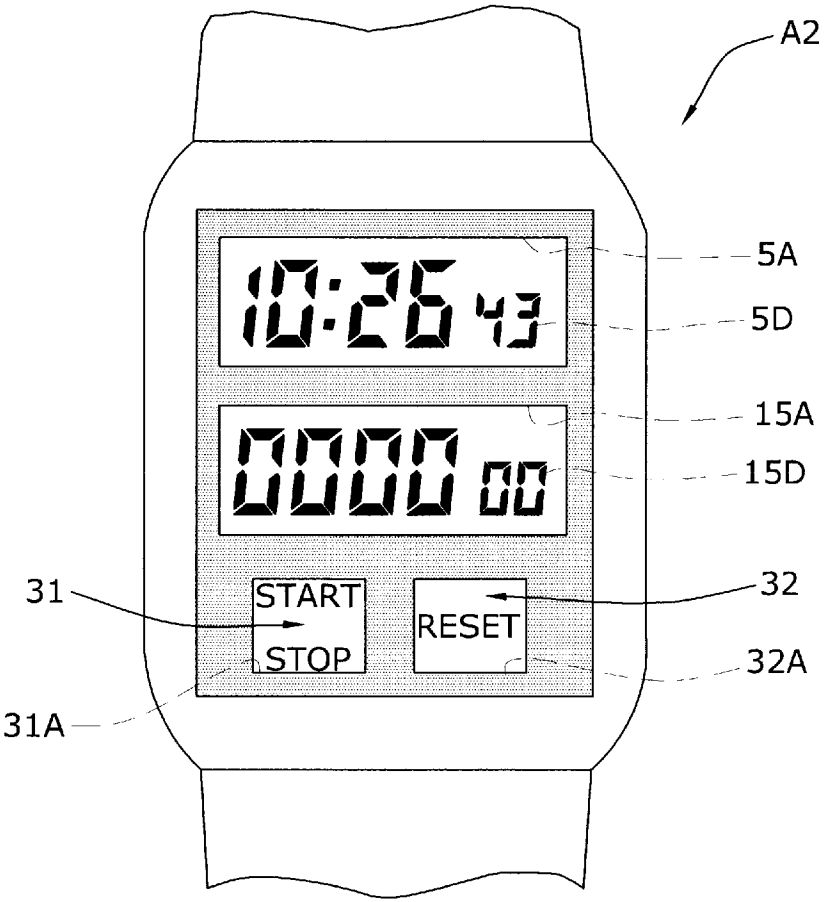
FIG. 6 is a top plan view of the embodiment 3 of the same small-sized electronic apparatus, with FIG. 6(*a*) being a top plan view showing the state where a shutter of the embodiment 3 of the same small-sized electronic apparatus is opened, and FIG. 6(*b*) being a top plan view showing the state where the shutter of the embodiment 3 of the same small-sized electronic apparatus is closed.
Figure 6A:
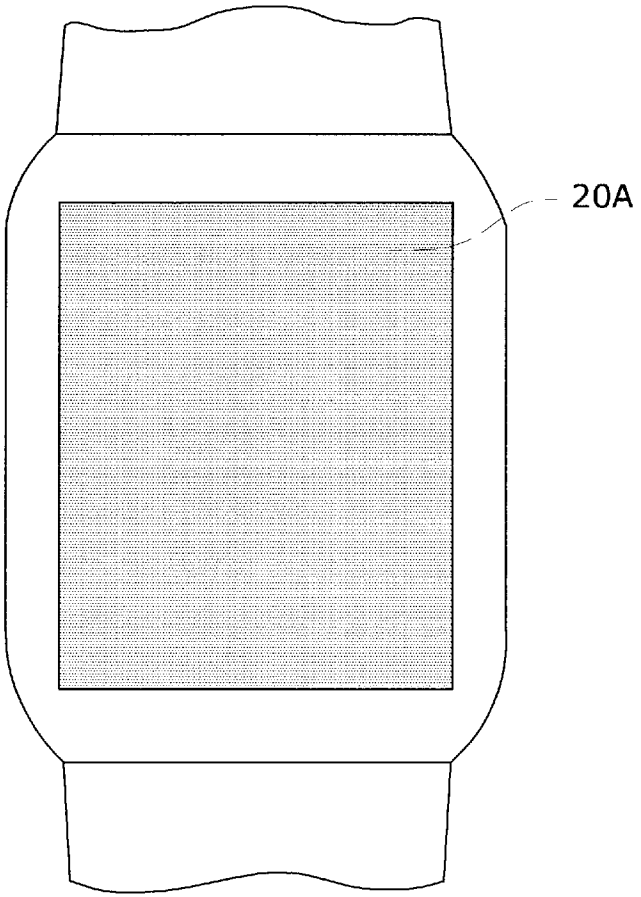
Figure 7:
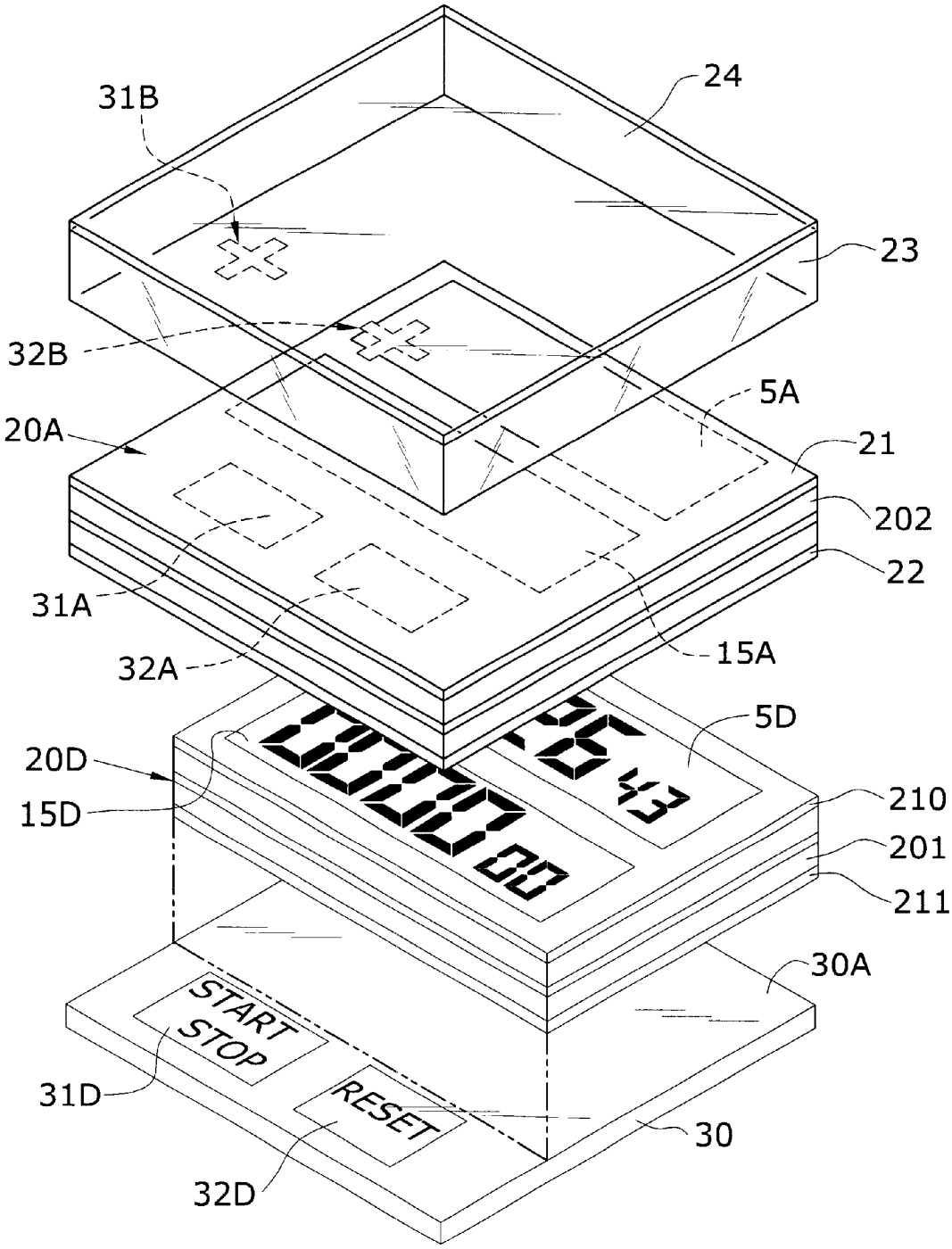
FIG. 7 is an exploded perspective view showing a schematic configuration of embodiment 3 of the display part of the same small-sized electronic apparatus.

Embodiment 3 of a small-sized electronic apparatus in accordance with the present invention is shown in FIGS. 5 to 7.

FIG. 5 is a system block diagram of the embodiment 3 of the small-sized electronic apparatus in accordance with the present invention, and FIG. 6 is a top plan view of the same small-sized electronic apparatus. FIG. 6(*a*) is a top plan view showing the state where the shutter of the same small-sized electronic apparatus is opened, while FIG. 6(*b*) is a top plan view showing the state where the shutter of the same small-sized electronic apparatus is closed. FIG. 7 is an exploded perspective view showing a schematic configuration of the display part of the same small-sized electronic apparatus.

The embodiment 3 of the small-sized electronic apparatus is described byway of example of a digital quartz watch A2. Except that information generating means 101 further comprises a chronological information generating circuit 15, with the provision of first display drive means 61, second display drive means 62 and a display unit 17, the watch A2 of FIG. 5 has the same configuration as that of the embodiment 2 and hence uses the same reference numerals.

On the basis of a predetermined reference signal from the reference signal generating circuit 2, the time counter in the form of the time information generating circuit 50 counts the time and issues a time signal. Then, based on the time signal, the liquid crystal driver in the form of the first drive means 61 imparts a display drive signal to a liquid crystal display panel 20D serving as the display unit 17. The liquid crystal display panel 20D includes an absorption type deflecting plate 210 and an absorption type deflecting plate 211 which are layered with a liquid crystal cell 201 sandwiched between. A time display appears on a time display part 5D of the liquid crystal display panel 20D.

Likewise, based on a predetermined reference signal from the reference signal generating circuit 2, the chronological counter in the form of the chronological information generating circuit 15 counts the chronological measuring time and issues a chronological signal. Then, based on the chronological signal, the second display drive means 62 acting as the liquid crystal driver issue a display drive signal, providing a display of stop watch (chronological measurement) function as chronological information on a chronological display part 15D of the liquid crystal display panel 20D. The actuation, stop and reset to zero of the chronological information generating circuit 15 are effected by an operation switch signal from a shutter unit 18.

Then, in order to allow the shutter unit 18 of a shutter part B2 to be driven as a shutter, in the same manner as the embodiment 1, a switching signal issued from the switching means 9 is fed as a control signal to shutter control means 110 which includes an opening/closing control circuit 111 for controlling the shutter opening/closing action and an opening/closing drive circuit 130 for driving the shutter, the switching signal being output as a control signal for controlling the shutter opening/closing action of the shutter unit 18. For the purpose of forming a drive signal for the shutter unit 18, the opening/closing drive circuit 130 is fed with a predetermined reference signal from the reference signal generating circuit 2.

A liquid crystal shutter panel 20A constituting the shutter unit 18 includes as shown in FIG. 7 an absorption type deflecting plate 21 and a:reflection type deflecting plate 22 which are layered with a liquid crystal cell 202 interposed therebetween, the cell having segmented therein a time information shutter window 5A, a chronological information shutter window 15A, as well as a start/stop switch window 31A and a reset switch window 32A.

When the same switching means 9 as in the embodiment 1 issue a switching signal, the shutter unit 18 of the shutter part B2 allows the time information shutter window 5A and chronological information shutter window 15A as well as the start/stop switch window 31A and reset switch window 32A, all of which are segmented in the liquid crystal cell 202 of the liquid crystal shutter panel 20A, to be put in the display states due to the application of voltage, allowing the time information and chronological information displayed on the time display part 5D and the chronological display part 15D of the underlying display unit 17 to be visible through the windshield glass 23.

Description will now be given of switch members 31 and 32 for actuating, stopping and zero resetting the chronological information generating circuit 15. As shown in FIG. 7, transparent electrodes are arranged substantially crosswise in plan view both on the top surface of the windshield glass 23 and on the bottom surface of a transparent touch panel so that the associated portion of the transparent touch panel 24 is pressed for contact, whereby detection parts 31B and 32B are provided for detecting the switching action.

Switch letters 31D and 32D are also formed by printing or the like on a reflective surface 30A of a reflection plate 30 in such a manner that the detection parts 31B and 32B are coincident in geometry in top plan view with the switch windows 31A and 32A and the switch letters 31D and 32D, respectively. Therefore, simultaneously with the time display part 5D and chronological display part 15D being displayed, reflected light from the reflection plate 30 allows the switch letters 31D and 32D to pass through the switch windows 31A and 32A of the liquid crystal shutter panel 20A which has been put in the display state (shutter opened state) as a result of voltage application, and further, through the detection parts 31B and 32B sandwiched between the windshield glass 23 and the touch panel 24, rendering them visible as the switch members 31 and 32. Then, the regions of the detection parts 31B and 32B of the touch panel 24 are pressed to put them in a switched-on state, enabling the chronological information generating circuit 15 to be activated.

Figure 8:
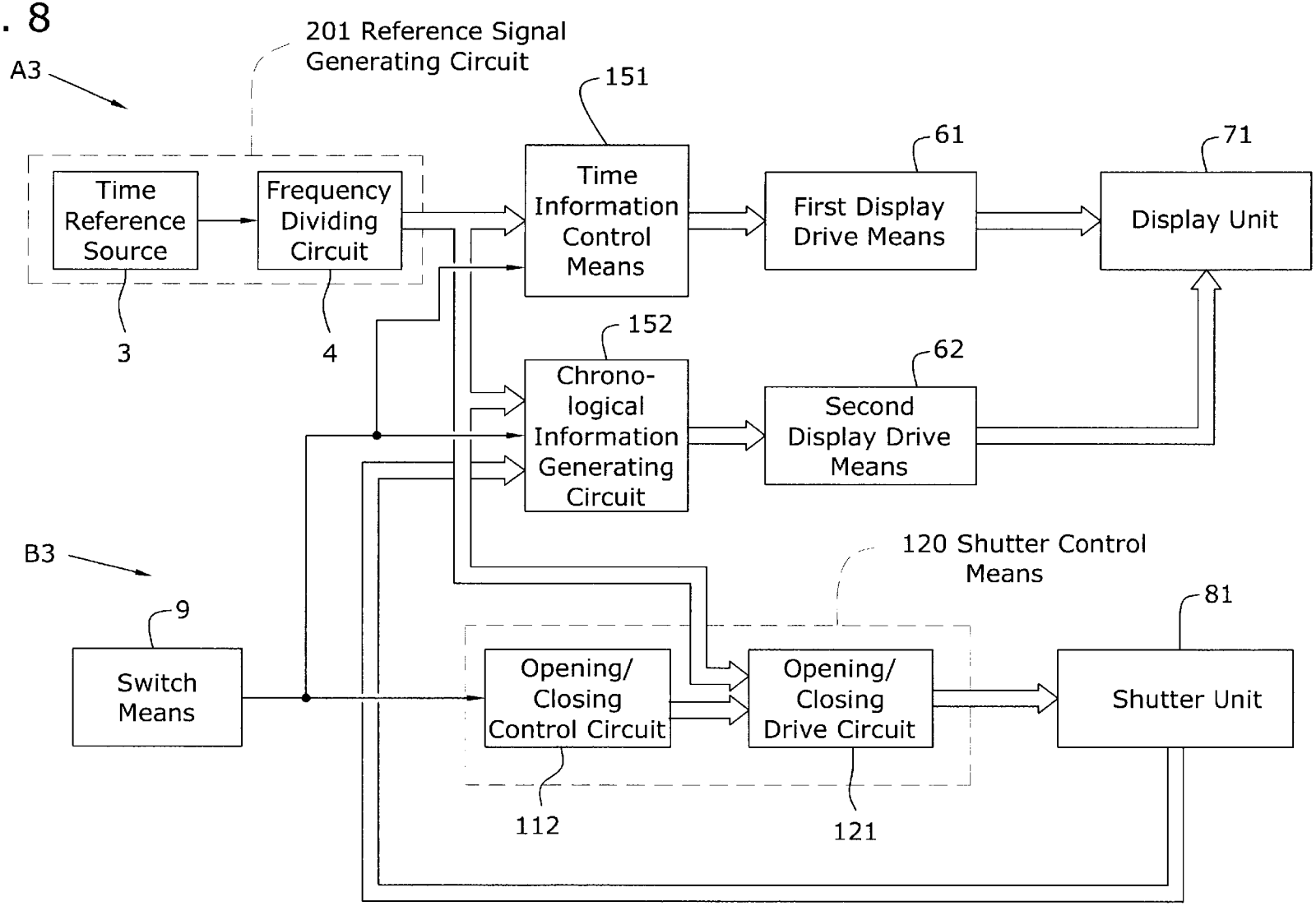
FIG. 8 is a system block diagram of embodiment 4 of a small-sized electronic apparatus in accordance with the present invention.
Figure 9B:
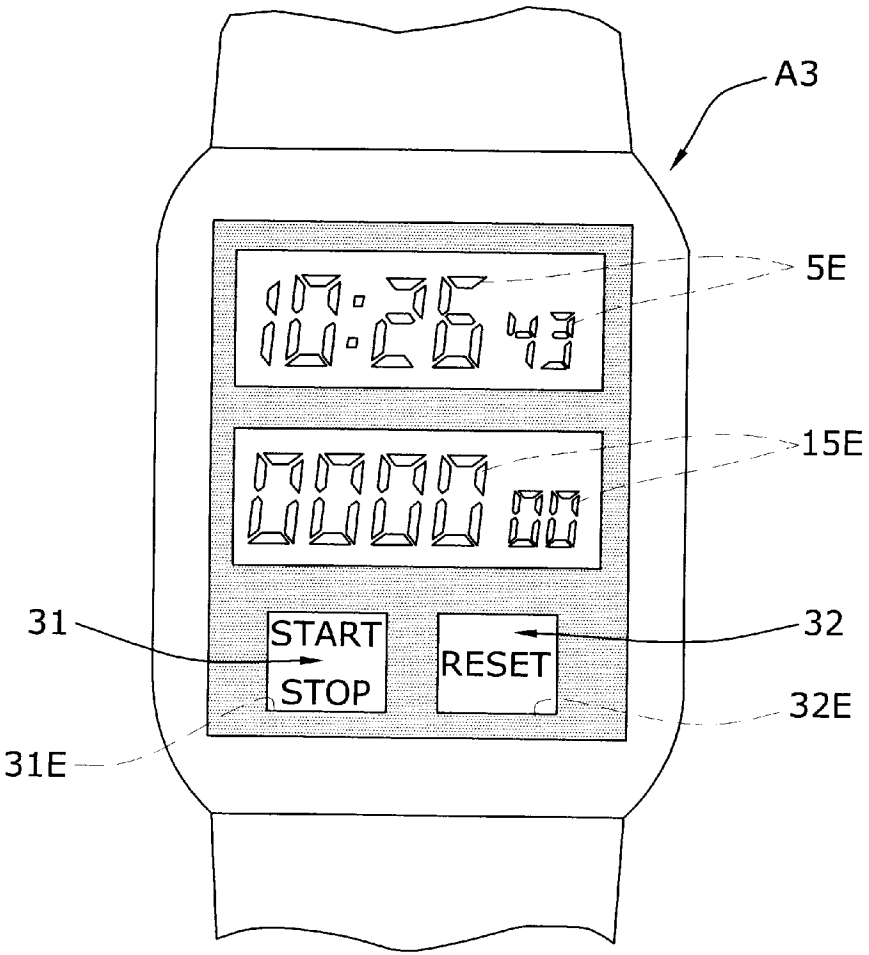
FIG. 9 is a top plan view of the embodiment 4 of the same small-sized electronic apparatus, with FIG. 9(*a*) being a top plan view showing the state where a shutter of the embodiment 4 of the same small-sized electronic apparatus is opened, and FIG. 9(*b*) being a top plan view showing the state where the shutter of the embodiment 4 of the same small-sized electronic apparatus is closed.
Figure 9A:
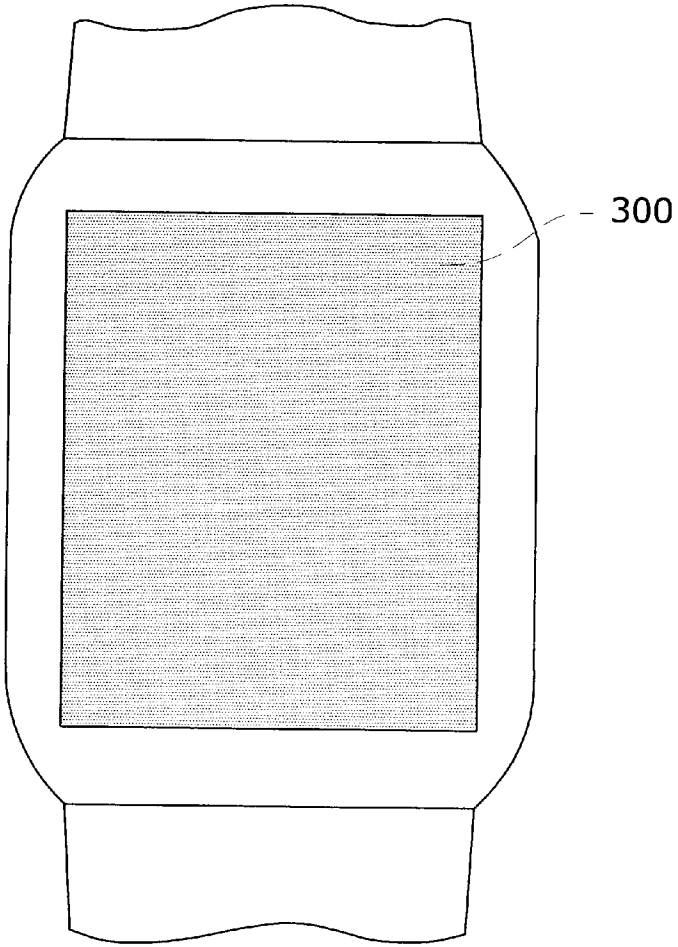

Embodiment 4 of a small-sized electronic apparatus in accordance with the present invention is shown in FIGS. 8 to 10.

FIG. 8 is a system block diagram of the embodiment 4 of the small-sized electronic apparatus in accordance with the present invention, and FIG. 9 is a top plan view of the same small-sized electronic apparatus. FIG. 9(*a*) is a top plan view showing the state where the shutter of the same small-sized electronic apparatus is opened, FIG. 9(*b*) is a top plan view showing the state where the shutter of the same small-sized electronic apparatus is closed, and FIG. 10 is an exploded perspective view showing a schematic configuration of a display part of the same small-sized electronic apparatus.

The embodiment 4 of the small-sized electronic apparatus is described by way of example of a digital quartz watch A3. As shown in FIG. 10, this embodiment has basically substantially the same configuration as the embodiment 3 except that a single-layered liquid crystal panel presents the equivalent function although the embodiment 3 employs a two-layered liquid crystal panel. In FIG. 18, a signal from reference signal generating means 201 is fed to time information control means 151, chronological information control means 152 and an opening/closing drive circuit 121. A signal from the time information control means 151 is fed as a first display drive signal via first display drive means to a display unit 71, while a signal from the chronological information control means 152 is fed as a second display drive signal via second display drive means 62 to the display unit 71.

A switching signal output from the switch means 9 is fed as a control signal to shutter control means 120 which include an opening/closing control circuit 112 for providing a control of opening/closing action of the shutter for switching and an opening/closing drive circuit 121 for driving the switching shutter, the switching signal being output as a control signal for controlling the shutter opening/closing action of a switching shutter unit 81 for switching. At the same time, the switching signal output from the switch means 9 is fed to both the time information control means 151 and the chronological information control means 152. For the purpose of forming a drive signal for the shutter unit 81 for switching, the opening/closing drive circuit 121 is fed with a predetermined reference signal from the reference signal generating means 201.

As shown in FIGS. 9 and 10, a display segment 5E driven by the time information control means 151 and a display segment 15E driven by the chronological information control means 152 are put in the transmitted state, allowing the reflected light from the reflective surface 30A of the reflection plate 30 to pass through, to render the display information visible, with the display segments 5E and 15E being provided on the liquid crystal cell 200 just in an inverted state (negative state) relative to the segment display of the embodiment 3, on the basis of the switching signal from the switch means 9, and this signal is fed to the time information control means 151 and the chronological information control means 152.

Then, with respect to the switch members 31 and 32 (see FIG. 9) for actuating, stopping and zero resetting the chronological information control means 152, the switch letters 31D and 32D are allowed to pass through switch windows 31E and 32E of a single-layered liquid crystal display shutter panel 300 which has been put in the display state as a result of voltage application, and further through the detection parts 31B and 32B sandwiched between the windshield glass 23 and the touch panel 24, rendering them visible as the switch members 31 and 32. Thus, the detection parts 31B and 32B of the touch panel 24 are pressed to put them in a switched-on state, enabling the chronological information control means 152 to be actuated. This is the same as the embodiment 3.

Arrangement is such that as shown in FIG. 10 either one of the absorption type deflecting plate 21 and the reflection type deflecting plate 22 is fixed, with the other deflecting plate being rotated. At the angle (0°) where the transmission axis X of the absorption type deflecting plate 21 is parallel to the transmission axis X of the reflection type deflecting plate 22, a reflection characteristic is exhibited without any voltage application with the 90° twisted nematic (TN) liquid crystal cell 200 interposed, whereas a transmission characteristic is exhibited with the presence of voltage application (voltage applied segment). For this reason, the external light source presents a lustered reflection characteristic without any voltage application, allowing provision of a shutter with a tone of metallic luster (metallic tone) with the incidence of light through the windshield glass 23 of the watch. Use of the reflection type deflecting plates as both the deflecting plates would also ensure the same functions and effects as the above.

Although in the above embodiments 1 to 4 the absorption type deflecting plate 21 was used as the upper deflecting plate with the reflection type deflecting plate 22 as the lower deflecting plate, it would also be effective to use the reflection type deflecting plate 22 as both the upper and lower deflecting plates or alternatively to use the reflection type deflecting plate 22 as the upper deflecting plate with the absorption type deflecting plate 21 as the lower deflecting plate.

Industrial Applicability

As set forth hereinabove, the present invention is suitable for use as a watch or other small-sized electronic apparatus.

What is claimed is:

1. A small-sized electronic apparatus comprising: information generating means, display drive means for issuing a signal for display and drive on the basis of a signal from said information generating means, a display unit for providing an information display on the basis of an output signal from said display drive means, and a liquid crystal shutter for obstructing view of information displayed by said display unit, wherein said electronic apparatus comprises timer control means for performing timer counting action on the basis of an output signal from a Switch means, and display shoutout control means for providing switching control of said display unit between an information display state and a display shutout state by use of said shutter on the basis of a time-out signal from said timer control means.

2. A small-sized electronic apparatus comprising:

information generating means;

display drive means for issuing a signal for display and drive on the basis of a signal from said information generating means;

a display unit for providing an information display on the basis of an output signal from said display drive means;

a shutter, provided separately from or integrated with said display unit, for obstructing from view information displayed by said display unit, wherein said electronic apparatus comprises switch means for detecting a switch input;

display shutout control means for providing switching control of said shutter between an information display state in which said information is viewable, and a display shutout state in which a view of said information is obstructed by said shutter, and wherein said display shutout control means operates on the basis of an output signal from said switch means; and wherein said display shutout control means are configured to provide a switching control of said display unit from display shutout state to information display state on the basis of an output signal from said switch means, and wherein said electronic apparatus further comprises a timer control means for performing timer counting action on the basis of an output signal from said switch means, and wherein on the basis of a time-out signal from said timer control means said display shutout control means provide a switching control of said display unit from information display state to display shutout state.

3. A small-sized electronic apparatus according to claim 2 wherein said shutter includes liquid crystal provided in said display unit.

4. A small sized electronic apparatus according to any one of claim 2, wherein said switch means are sensor switch means for detecting a sensor switch input.

5. A small-sized electronic apparatus comprising:

information generating means;

display drive means for issuing a signal for display and drive on the basis of a signal from said information generating means;

a display unit for providing an information display on the basis of an output signal from said display drive means;

a shutter, provided separately from or integrated with said display unit, for obstructing from view information displayed by said display unit, wherein said electronic apparatus comprises switch means for detecting a switch input;

display shutout control means for providing switching control of said shutter between an information display state in which said information is viewable, and a display shutout state in which a view of said information is obstructed by said shutter, and wherein said display shutout control means operates on the basis of an output signal from said switch means; and wherein said display shutout control means are configured to provide a switching control of said display unit from an information display state to a display shutout state on the basis of an output signal from said switch means, and wherein said electronic apparatus further comprises timer control means for performing a timer counting action on the basis of an output signal from said switch means, and wherein on the basis of a time-out signal from said timer control means said display shutout control means provide a switching control of said display unit from display shutout state to information display state.

6. A small-sized electronic apparatus, comprising:

information generating means;

display drive means for issuing a signal for display and drive on the basis of a signal from said information generating means;

a display unit for providing an information display on the basis of an output signal from said display drive means;

a shutter, provided separately from or integrated with said display unit, for obstructing from view information displayed by said display unit, wherein said electronic apparatus comprises switch means for detecting a switch input;

display shutout control means for providing switching control of said shutter between an information display state in which said information is viewable, and a display shutout state in which a view of said information is obstructed by said shutter, and wherein said display shutout control means operates on the basis of an output signal from said switch means; and wherein said shutter includes liquid crystal provided in said display unit; and wherein said shutter comprises a reflection type deflecting plate.

7. A small-sized electronic apparatus comprising a watch, said watch comprising: information generating means, display drive means for issuing a signal for display and drive on the basis of a signal from said information generating means, and a display unit for providing an information display on the basis of an output signal from said display drive means, and wherein said information display includes time information, and wherein said display unit is provided with a switch member for controlling said time information of said information display, and wherein said watch further comprises a shutter unit, provided separately or integrated with said display unit, for obstructing view of said information display, said shutter unit having an opening for said switch member, and shutter control means for providing opening/closing control of said shutter unit.

8. A small-sized electronic apparatus according to claim 7, wherein said shutter of said shutter unit is a liquid crystal shutter which uses liquid crystal.

9. A small-sized electronic apparatus according to claim 8, wherein said liquid crystal shutter means comprises a reflection type deflecting plate.

* * * * *